United States Patent [19]

Haug

[11] Patent Number: 4,573,673

[45] Date of Patent: Mar. 4, 1986

[54] FEED MECHANISM FOR INDIVIDUAL FLAT ARTICLES

[75] Inventor: Werner Haug, Langnau, Switzerland

[73] Assignee: Frama AG, Switzerland

[21] Appl. No.: 656,961

[22] Filed: Oct. 2, 1984

Related U.S. Application Data

[63] Continuation of Ser. No. 342,140, Jan. 25, 1982, abandoned.

[30] Foreign Application Priority Data

Feb. 10, 1981 [CH] Switzerland ..... 883/81

[51] Int. Cl.[4] ..... B65H 3/06; B65H 7/02

[52] U.S. Cl. ..... 271/111; 271/10; 271/259; 271/265; 271/270

[58] Field of Search ..... 271/10–17, 271/23, 109, 110, 111, 258, 259, 265, 266, 270

[56] References Cited

U.S. PATENT DOCUMENTS

| | | | |
|---|---|---|---|
| 2,622,518 | 12/1952 | Peterson et al. | 271/10 |
| 3,322,602 | 5/1967 | Schneider | 271/35 |
| 3,556,511 | 1/1971 | Howard | 271/111 |
| 3,575,410 | 4/1971 | Suzuki | 271/111 |
| 3,583,696 | 6/1971 | Runzi | 271/265 |
| 3,791,516 | 2/1974 | Tramposch | 271/265 |
| 3,934,868 | 1/1976 | Selak | 271/13 |
| 3,988,017 | 10/1976 | Kyhl | 271/111 |
| 4,030,722 | 6/1977 | Irvine et al. | 271/111 |
| 4,074,902 | 2/1978 | Bradbury | 271/265 |
| 4,083,555 | 4/1978 | Irvine et al. | 271/111 |
| 4,113,244 | 9/1978 | Ruenzi | 271/270 |
| 4,331,328 | 5/1982 | Fasig | 271/11 |

FOREIGN PATENT DOCUMENTS

| | | | |
|---|---|---|---|
| 2249969 | 11/1973 | Fed. Rep. of Germany | 271/35 |
| 173757 | 3/1935 | Switzerland | 271/35 |
| 1071521 | 6/1967 | United Kingdom | 271/10 |
| 2024174 | 1/1980 | United Kingdom | 271/10 |

*Primary Examiner*—Bruce H. Stoner, Jr.
*Assistant Examiner*—James E. Barlow
*Attorney, Agent, or Firm*—McGlew and Tuttle

[57] ABSTRACT

An article feed mechanism for use in association with a franking device which operates on mail, comprises a feeding mechanism which includes an article feed path which is oriented so that it may be connected over a feed path of the franking device and which includes two separately driven conveyor sections. The first conveyor is driven by a drive motor and comprises a plurality of drive rollers which operate on the articles which are arranged in a stack at a stacking area and delivers them one at a time to the second conveyor mechanism which includes a pressure drive roller acting to drive the lowermost one of the articles under a sliding apron and then for advancing it into association with a driven roller cooperating with another overhead roller. A first sensor is located between the pressure roller and the cooperating over and under rollers and it acts when an article is advanced to disconnect the drive motor for the first conveyor. After the article leaves the sensor the sensor acts on a second motor to slow down a second driving conveyor. A second sensor is located downstream of the first sensor and it acts when an article approaches it to rapidly decelerate the second drive motor for the second conveyor.

7 Claims, 1 Drawing Figure

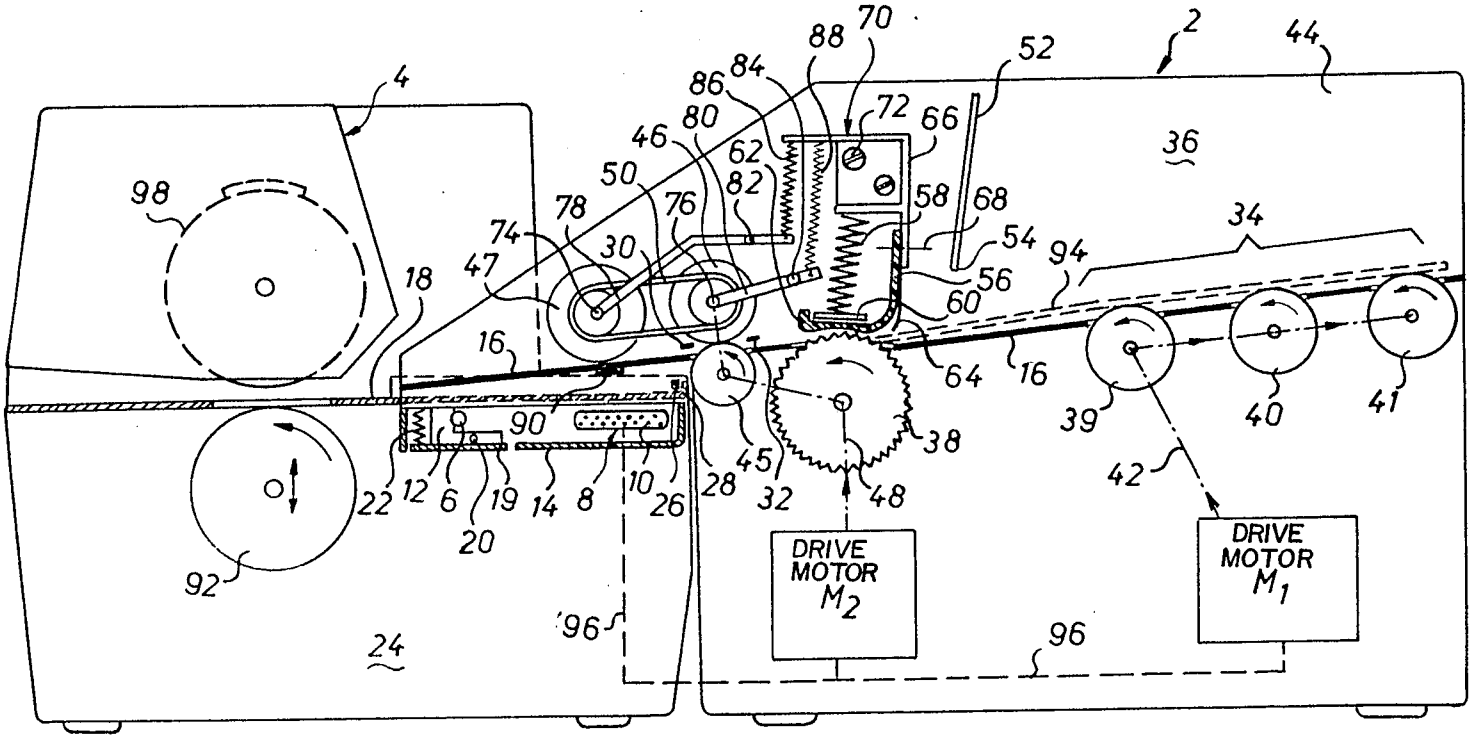
DRIVE MOTOR $M_1$
DRIVE MOTOR $M_2$

FEED MECHANISM FOR INDIVIDUAL FLAT ARTICLES

This is a continuation of application Ser. No. 342,140 filed Jan. 25, 1982, now abandoned.

FIELD AND BACKGROUND OF THE INVENTION

The invention relates to a feed mechanism for individual flat articles, which serves to feed articles from a stacking area to a subsequently arranged apparatus for the individual processing of the articles. The invention particularly refers to a device for feeding envelopes to a franking machine, whereby a conveying path commences in the stacking area, and at the outlet side of the stacking area there is a hold-back device for permitting the passage of only a single article on each occasion. The conveying path has at least two conveying sections and between the subsequently arranged apparatus and the feed mechanism an electrical connection is provided, which switches off the conveying system on disconnecting the subsequently arranged apparatus.

German Patent DAS No. 12 47 902 discloses a feed mechanism of this type in which conveying is intermittently interrupted by means of a cam control for adapting to the intermittent operation of the franking machine. However, the mechanical control of the franking machine to varying working cycle times occurring when franking envelopes of different length. The lack of adaptation means that franking does not always take place at the same point on different envelopes and in the case of particularly long envelopes double franking can occur, because the intermittent disconnection of the conveying system must be adapted to the smallest possible envelope.

BRIEF SUMMARY OF THE INVENTION

The present invention provides a feed mechanism, which automatically adapts to the working speed of the subsequently arranged apparatus for the individual processing of the articles, so that articles of different length can be supplied from a stack without encountering the disadvantages of the mechanism described hereinbefore.

According to the invention two spaced apart successively arranged sensors for the articles are disposed along the conveying path. The first sensor produces a signal for reducing the conveying speed and the second sensor produces a signal for stopping conveying through the feed mechanism and for starting individual processing through the subsequently arranged apparatus.

The second conveying section can have a higher conveying speed, so that in in the case of continuous conveying between successively conveyed articles a gap is obtained through which the sensors can respond to an individual article. By reducing the conveying speed after passing the first sensor it is possible, despite the possibly relatively high conveying speed and the corresponding inertia forces, that a particular article can be stopped at a precisely predetermined point after passing the second sensor by disconnecting the conveying system. This is necessary to obtain the precisely determined starting position for the subsequently arranged and intermittently operating apparatus. After individual processing has been carried out by this apparatus, it supplies a signal to the feed mechanism by means of a per se known electrical connection with the feed, so that the conveying is restarted. As a result the conveying speed of the feed mechanism is perfectly adapted to the operating speed of the subsequently arranged apparatus and can function as a constant intermittent manner.

According to a further advantageous development of the invention an independent drive is provided for each of the two conveying sections, the drive of the first conveying section being disconnected by a signal from the first sensor, which is formed when the leading edge of an article reaches said first sensor. As the first drive conveys the articles out of the stacking area, this ensures that an overlying article is not drawn along by frictional contact. At this moment conveying takes place by the second conveying section, so that the stationary conveying members of the first conveying section exert a braking action on that part of the following article not overlapping in the stack and the rear part of the conveyed article.

According to a further development of the invention at the end of the second conveying section there is a feed roller driven by the drive of this section and which extends into the vicinity of the subsequently arranged and intermittently operating apparatus, so that it is still in contact with the article when the article is conveyed by the conveying mechanism of the subsequently arranged apparatus and the drive of the second conveying section is disconnected. This ensures that the feed roller which initially contributes to the conveying action subsequently serves as a brake, so that after discontinuing conveying a further movement of the article is prevented by inertia forces.

Accordingly it is an object of the invention to provide an article feed mechanism for use in association with another device for operating on articles as they are fed along an operation path and particularly to feeding articles to a franking machine which includes means for controlling the operation of two separate conveyors of the feeding device so that the articles may be fed into proper association with the conveying mechanism of the operating device.

A further object of the invention is to provide an article feed mechanism which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWING

The only FIGURE of the drawing is a schematic longitudinal sectional view of a franking machine having an article feed mechanism associated therewith constructed in accordance with the invention.

DETAILED DESCRIPTION OF THE PREFERRED EMBODIMENT

Referring to the drawings in particular the invention embodied therein comprises an article feed mechanism generally designated 2 for use in association with another device for operating on articles as they are fed along an operating path particularly to a franking machine generally designated 4. The feeding mechanism includes means defining an article feed path over plate 16 which is adapted to be associated with the operating path of a plate 18 of the franking machine 4. The feed mechanism includes a first conveyor means 34 including rollers 39, 40 and 41 which are driven from a first drive means in the form a a drive motor $M_1$. In addition the feed mechanism includes a second conveyor means including pressure rollers 38 cooperating over and under rollers 45 and 46 and a further feed roller 47 which is disposed along a portion of the article feed path or plate 16 downstream or after the first conveyor means. A second drive means in the form of a variable speed drive motor $M_2$ is connected to the second conveyor means to drive it at selected speeds. The speed mechanism also includes first sensor means 32 connected to the first drive means $M_1$ which is located along the feed plate 16 adjacent the second conveyor means and acts to stop the first drive means when an article is fed along said feed path to said first sensor means 32. The feed mechanism also includes a second sensor means 30 connected to the second drive motor $M_2$ and adapted to be connected to the device which will further operate on the articles and it acts to stop the second drive means and to start the device of franking machine 4.

The connection between feed mechanism 2 and franking machine 4 is mechanically provided by a guide or cotter pin 6 running at right angles to the conveying direction and is electrically provided by a plug connection 8. As both plug parts of plug connection 8 are firmly connected to either the franking machine 4 or the feed mechanism 2, electric contact takes place simultaneously with the forming of the mechanical connection in that the guide pin 6 ensures a precise alignment and guidance until latching-in takes place by means of a latch 12 engaging in a notch or a groove of the guide pin 6.

The latching mechanism as well as the electric plug part associated with the feed mechanism are housed in a small common flat housing 14 spaced below the table plate 16 of feed mechanism 2. As a result of this spacing a gap is provided, which serves to receive the laterally projecting table plate 18 of franking machine 4. Part 19 of the lower wall of the flat housing 14 is pivotable about a spindle 20 counter to the tension of a tension spring 22. Latch 12 is fixed to wall part 19, so that tension spring 22 maintains latch 12 is engagement with the notch on the guide pin 6, which projects laterally from the housing wall 24 of the franking machine 4.

Engagement and disengagement of feed mechanism 2 is made very simply and rapidly by this advantageous latching mechanism, because on gripping under the housing part 14 of feed mechanism 2, which projects in the conveying direction, the fingertips of the left hand swivel wall part 19 in such a way that the latching system is disengaged and decoupling can take place by lateral displacement of the feed mechanism relative to the franking machine. Therefore the franking machine can be used both with and without the feed mechanism. When used without the feed mechanism a working cycle is started by a mechanical contact 26 located at the start of the franking machine table plate 18. An envelope is placed on table plate 16 at right angles to the conveying direction of the franking machine is such a way that it abuts against edge 28 of the table plate 16 on which is located the mechanical contact 26. The position of mechanical contact 26 thus determines the starting position of an envelope during a working cycle of the franking machine.

If the envelopes are supplied by means of the feed mechanism according to the invention, the feed movement takes place at an angle to the conveying path of the franking machine and mechanical contact 26 cannot serve to start a working cycle of franking machine 4. The feed mechanism consequently has a sensor 30, e.g. a photoelectric cell which, with respect to the conveying section, is arranged at the same point as the mechanical contact 26 of the franking machine. When the trailing edge of an envelope supplied by the feed mechanism 2 of the franking machine 4 passes the feed mechanism 2 at sensor 30, it gives a signal for starting a working cycle of the franking machine 4, so that it replaces the the function of mechanical contact 26 when the franking machine is used above.

To prevent an immediate after-conveying of a further envelope before a working cycle of the franking machine is ended, the conveying of the feed mechanism 2 must be interrupted if the sensor 30 has initiated a working cycle of the machine 4. It is also necessary for the reliable operation of the franking machine for the fed-in envelope to stop or at least be slowed down at the beginning of the franking machine, because the subsequent conveying is to take place solely by the feed mechanism of the franking machine, uninfluenced by a kinetic energy received by the envelope in the feed mechanism. To this end and with respect to the conveying direction in front of sensor 30 is provided a further sensor 32 of the conveying path of the feed mechanism. Hereinafter sensor 32 is referred to as the first sensor 32, because the envelopes reach it first. This first sensor supplies a signal for slowing down the conveying speed of the feed mechanism 2, so that stopping at an exactly predetermined point after passing the second sensor 30 is possible.

Advantageously the first sensor 32 serves to disconnect the drive $M_1$ of a first conveying section 34 of feed mechanism 2 when the sensor 32 aligns with the leading edge of an envelope being fed. This reliably prevents the lowermost envelope of a stack of empty or varyingly thickly filled envelopes located in a stacking area 36 and which is already in conveying contact with the sluice roller 38, from being dragged along by frictional contact with the overlying envelope. The higher the stack in stacking area 36 the greater this frictional contact, so that unevenness of the envelope could also lead to dragging along. When the conveying rollers 39, 40 and 41 of the conveying section 34 which are arranged in the bottom of stacking area 36, are stationery they hold back the following envelope which is only subsequently to be conveyed, because this envelope at least rests on one of the rollers, as a function of the conveying section already travelled by the envelope being conveyed, i.e. a contact with the next-following envelope takes place successively with the then stationary rollers 41, 40, 39 of conveying section 34. For this effect the distance between conveyor section 34 and rollers 38, 45, 46, 47 is less than the length of an envelope to be conveyed.

It is obvious that the conveying members 39 to 41 of the first conveying section 34 can be independently disconnected in various ways. However, in the represented embodiment the feed mechanism has for this purpose two independently operating drive motors $M_1$ for the first conveying section 34 and $M_2$ for the following conveying section in the conveying direction. The disconnection of the first conveying section 34 is consequently brought about electrically by switching off motor $M_1$ due to a pulse from sensor 32. The driving connection between motor $M_1$ and driving rollers 39 to 41 is diagrammatically indicated in the drawing by a dot-dash line 42 and can take place e.g. through a slip-free gear wheel transmission. The shafts of motors $M_1$ and $M_2$, as well as the various driving rollers extend through the lateral housing wall visible in the drawing and are mounted therein, so that the gear wheels for the drive transmission are located, e.g. on the other side of the housing wall as compared with the driving rollers. The second bearing point of the rollers is located in a second wall, which is not visible in the drawing and which is fixed parallel to housing wall 44 below the conveying table plate 16.

The second conveying section with drive motor $M_2$ has four driven conveying rollers 38, 45, 46, 47, whereof the two rollers 46, 47 serve as feed rollers and are positioned above conveying table plate 16. The driving connection from motor $M_2$ to the rollers is also diagrammatically indicated by a dot-dash line 48. For example the driving connection from motor $M_2$ to the rollers positioned below table plate 16 takes place in slip-free manner by means of gear wheels, while the further driving connection to the rollers 46, 47 arranged above table plate 16 and starting from roller 45 is brought about by endless driving belts, whereof driving belt 50 between rollers 46, 47 can be seen in the drawing. The driving belts permit slip in the case of overloading, so that they are preferred for safety reasons. Rollers 45 and 46 form a pair of nip rollers for the second conveyor section.

In the conveying direction and at right angles thereto stacking area 36 has a baffle plate 52, whose lower edge 54 is spaced from the slightly sloping conveying table plate 16, so that only the lower envelopes of a higher stack can be moved in the conveying direction to the hold-back apron 56. The apron 56 is made from a flexible material, e.g. rubber, and part thereof rests on the top of sluice roller 38, which by means of a feed plate 60 loaded by a spring 58 can additionally be pressed elastically against roller 38. Pressure plate 60 rests loosely on the deflected apron part. To prevent the pressure plate 60 from sliding from sliding from said apron part, the latter has a flange 62 at its free end. The width of the hold-back apron 56 is e.g. 50 mm and it is positioned e.g. at a distance of 8 mm from the right-hand housing wall 44 in the conveying direction and along which is laterally guided the envelopes.

On the side facing stacking area 36 a sliding apron 64 engages on the holdback apron 56. At its upper end sliding apron 64 is fixed together with holding-back apron 56 to a holding web 66, e.g. by means of three juxtaposed screws, which are inicated by a dot-dash line 68. Holding web 66 forms part of a holding frame 70, which is fixed e.g. by two screws 72 to the lateral housing wall 44. Sliding apron 64 is made from a flexible foil with a smooth surface, e.g. of silicone paper, and has the task of feeding the leading edge of the lower envelopes of a stack to the gap between the sluice rollers 38 and the engaging holding back apron 56. Without the sliding apron 64 the leading edge of the envelopes could receive a too high frictional action from the rubber material of holding-back apron 56. The apron 64 ensures the further movement of the envelopes.

The spindles 74 and 76 of the conveying and feed rollers 46, 47 positioned above the conveying table plate 16 are in each case located at the end of a lever 78, 80 which are pivoted about a spindle 82, 84 fixed to the housing side wall 44. A tension spring 86, 88 engages at the other end of the particular levers 78, 80 and has an upper end which is fixed to the holding frame 70. Thus, the conveying and feed rollers 46 and 47 can be deflected upwards in accordance with the particular thickness of a filled or empty envelope and are pressed against the top of the conveyed envelope by the tension of springs 86, 88 via the lever action of levers 78, 80. The first conveying and feed roller 46 in the conveying direction also has a driven counter-roller 45, while a sliding plate 90, e.g. of Nylon, Teflon, etc., can be provided below the second conveying and feed roller 47.

As can be gathered from the drawing the second conveying and feed roller 47 is positioned above table plate 18 of franking machine 4 which, when the feed mechanism is connected, is covered by the conveying table plate 16 of the feed mechanism. This arrangement of the second conveying and feed roller has the advantage that the conveying section of the feed mechanism is extended with conveying contact to above the franking machine. This arrangement also slows down the envelope after the disconnection of drive $M_2$ of the second conveying section in the starting position for a working cycle of franking machine 4. At the start of this working cycle the franking machine conveying roller 92 lifts and in this way takes on the necessary further conveying of envelopes as the final feed mechanism roller 47 in the conveying direction still holds the envelope, franking machine conveying roller 92 still exerts a corresponding tensile force on the envelope, so that the latter is under tensile stress, which leads to a flattening out thereof. This flattening action on the envelope, which acts against any crumpling or damming back thereof, also results from the fact that the second conveying and feed roller 47 in the conveying direction has a somewhat larger diameter than the first conveying and feed roller 46, although the rotational speed is the same due to the driving coupling by means of endless belt 50.

Hereinafter the operation of the feed mechanism is described in greater detail in conjunction with the franking machine. The envelopes to be fed to the franking machine are placed in stacking area 36, whereby envelopes of different thicknesses and lengths can be inserted in an irregular order. The right-hand lateral edge of the envelope in the conveying direction is guided through housing wall 44. A slide member (not shown) is provided on the opposite longitudinal side and can be set to the width of the envelopes at right angles to the conveying direction. After operating a switch (not shown) which is fitted to the feed mechanism and which is, for example, located on the lateral end plate of flat housing 14, effects the switching on of the two drives $M_1$ and $M_2$ so that the lowermost envelope, indicated by broken lines and which rests on the conveying rollers 39 to 41 of the first conveying section is conveyed to sluice roller 38. Part of the overlying envelopes is also moved until the leading edges thereof are held back at the holding back apron 56 or sliding apron 64. By means of its profiled adhesive surface, e.g. of rubber, sluice roller 38 comes ino frictional contact with the leading edge and bottom of envelope 94 and draws it into the gap between sluice roller 38 and holding-back apron 56. Due to the pressure of the holding back apron 56 in the direction towards the sluice roller 38, envelope 94 is securely grasped and drawn to the conveying roller pair 45, 46. Before reaching the roller pair 45 and 46 the leading edge of the envelope passes the photoelectric cell sensor 32, which produces a signal for the disconnection of drive $M_1$ of the first conveying section 34 and consequently holds back the next envelope which is to be subsequently conveyed.

After the leading edge of the envelope has entered the gap between conveying rollers 45, 46, the upper roller 46 rises as a function of the envelope thickness and causes a pressure to be exerted against the lower conveying roller 45. Conveying through rollers 45, 46 preferably takes place somewhat more rapidly than through sluice roller 38, so that the envelopes are flattened and any damming back thereof is reliably prevented. The sècond conveying and feed roller 47 then grasps the envelope, once again in preferred manner at a somewhat higher conveying speed (due to its greater diameter) and conveys it in the direction of the franking table 18. Thus the conveying speed increases in the conveying direction.

When the trailing edge of the envelope passes the first sensor 32, the latter supplies a signal for slowing down the conveying speed in the second conveying section through acting on the associated drive $M_2$. For this purpose first sensor 32 is connected to both drives $M_1$ and $M_2$. This slowing down effect is necessary to subsequently bring about an immediate stoppage, while taking account of the inertia forces of the drive system and of the conveyed envelope, when the trailing edge of said envelope passes the second sensor 30. As a result of its signal the second sensor ensures that motor $M_2$ is rapidly decelerated until it stops by short-circuiting or by a countercurrent. In addition, a signal is supplied to franking machine 4 for starting a franking cycle and finally a third signal is supplied for switching on drive $M_1$ again with a slower conveying speed. As a result of the reconnection of drive $M_1$ a following envelope is conveyed, while the preceding envelope is being franked.

After the envelope has traversed a certain area in the franking machine, the latter supplies by means of line 96, indicated by broken lines, a signal to the feed mechanism or its drives $M_1$, $M_2$ for the full power connection of the drives of both conveying sections, so that the described conveying process is repeated for the next envelope. Line 96 represents connection means for restarting drives $M_1$ and $M_2$.

This signal is advantageously produced by a cam-operated switch (not shown) by the trip cam being e.g. firmly connected to the shaft of the franking head 98 so that it travels past a fixed, not shown switch when the franking head is rotating.

While a specific embodiment of the invention has been shown and described in detail to illustrate the application of the principles of the invention, it will be understood that the invention may be embodied otherwise.

What is claimed is:

1. An article feed mechanism for use in association with another device for operating on a flat article as it is fed along an operating path, particularly a franking machine which operates on mail, comprising:

means defining an article feed path adapted to be associated with the operating path of the device;

a stacking area plate in said article feed path adapted to receive flat articles of different size stacked one on top of another;

a lateral wall adjacent said stacking area plate;

a baffle plate having a lower edge spaced from said stacking area plate by a distance to allow at least one article to pass said baffle plate on said article feed path;

first conveyor means disposed along a portion of said article feed path upstream of said baffle plate for feeding articles along said portion of said article feed path, a lowermost flat article being pressed against said first conveyor means by the weight of the articles received on said stacking area plate;

first drive means connected to said first conveyor means to drive said first conveyor means;

second conveyor means disposed along a portion of said feed path downstream of said first conveyor means for feeding an article;

second drive means connected to said second conveyor means to drive said second conveyor means at selected speeds;

a flexible hold-back apron having a part resting on a portion of said second conveyor means;

first sensor means connected to said first drive means and being located along said feed path adjacent said second conveyor means and acting to stop said first drive means when an article is fed along said feed path to said first sensor means;

second sensor means connected to said second drive means and adapted to be connected to the device and acting to stop the second drive means and start the device, said first and second sensor means being located in said article feed path direction downstream of said hold-back apron;

said first sensor means being connected to said first drive means and said second drive means, said first sensor means producing a signal for reducing the conveying speed of said second conveyor means by acting on said second drive means when a trailing edge of the article passes said first sensor means; and connection means connected to said first and second drive means and connected to the device so that a signal connection is provided between the device and the feed mechanism for restarting said first and second drive means of said first and second conveyor means.

2. An article feed mechanism according to claim 1, wherein said means defining an article feed path extends outwardly from said feed mechanism and is engageable over the operating device, said operating device comprising a franking machine and coupling means defined between said franking machine and said feeding mechanism and including an electrical plug unit for coupling these parts together mechanically and electrically.

3. An article feed mechanism according to claim 1, wherein each of said first and second conveyor means includes a plurality of conveying members successively arranged in a conveying direction along said feed path and which come into contact with the article, a downstreammost one of said conveying members of said first conveyor means being spaced from an upstreammost one of said conveying members of said second conveyor means by less than a length of the article along said article feed path.

4. An article feed mechanism according to claim 1, wherein said second conveying means comprises a plurality of rotatable members arranged along said feed path in succession for producing a conveying speed which increases in the conveying direction.

5. An article feed mechanism according to claim 1, sherein said second conveyor means includes a first driving feed roller connected to said second drive means, a second driving feed roller spaced further along the feed pathfrom said first driving feed roller and connected to said first driving feed roller for rotation therewith, said second driving feed roller being located adjacent the end of said feed mechanism which is directly adjacent the operating device so that it is still in contact with the article which is fed along said feed path when said first and second drive means are disconnected.

6. An article feed mechanism according to claim 2, wherein said franking machine includes an outer housing, means defining a table plate feed space along which the articles are fed which is adapted to be moved into position underlying said means defining an article feed path of said feeding machine, a small housing defined under said feed plate of said franking machine including a latching mechanism latchably engageable to a part on said feeding device.

7. An article feed mechanism according to claim 6, wherein said small housing on said franking machine includes a latching wall pivotally mounted on said housing and defining the lower end thereof and being pivotable to a closed position in which it latches against a part of said feed mechanism.

* * * * *